United States Patent [19]

Haverstick

[11] Patent Number: 4,867,809

[45] Date of Patent: Sep. 19, 1989

[54] METHOD FOR MAKING FLAKES OF RE-FE-B TYPE MAGNETICALLY ALIGNED MATERIAL

[75] Inventor: Jerry E. Haverstick, Muncie, Ind.

[73] Assignee: General Motors Corporation, Detroit, Mich.

[21] Appl. No.: 187,133

[22] Filed: Apr. 28, 1988

[51] Int. Cl.[4] ..... H01F 1/06

[52] U.S. Cl. ..... 148/101; 148/105; 148/120

[58] Field of Search ..... 148/101, 105, 120

[56] References Cited

U.S. PATENT DOCUMENTS

| | | | |
|---|---|---|---|
| 4,496,395 | 1/1985 | Croat | 148/301 |
| 4,597,938 | 1/1986 | Matsuura et al. | 148/105 |
| 4,601,875 | 7/1986 | Yamamoto et al. | 419/23 |
| 4,684,406 | 8/1987 | Matsuura et al. | 148/105 |
| 4,756,775 | 7/1988 | Croat | 148/302 |

FOREIGN PATENT DOCUMENTS 133758 3/1985 European Pat. Off. .

OTHER PUBLICATIONS

Lee, R. W., "Hot-Pressed Neodymium-Iron-Boron Magnets," *Applied Physics Letters*, 46, (8), Apr. 15, 1985.

*Primary Examiner*—Melvyn J. Andrews
*Assistant Examiner*—George Wyszomierski
*Attorney, Agent, or Firm*—George A. Grove

[57] ABSTRACT

A method and apparatus for producing rare earth (RE), iron, boron type anisotropic magnetic material includes process steps of forming dense substantially magnetically isotropic coarse powder particles of melt spun alloy with a very fine grain $RE_2Fe_{14}B$ phase; heating such particles (e.g. by plasma spraying) and directing them against hot working rolls at the entrance thereof; and hot deforming the particles while in a plastic state between surfaces of the hot working rolls so as to cause crystallites in the particles to be oriented along a crystallographically preferred magnetic axis. The particles are cooled and ejected from the rolls as individual anisotropic permanently magnetic flakes. Apparatus including a feed hopper with a carrier tube pressurized to direct isotropic particles to the arc of a plasma spray torch. The torch softens the particles and sprays them in a spatter pattern. The apparatus further includes a pair of counter-rotating rollers with a gap therebetween to receive the spatter pattern and to shape individual plastic particles into flake form.

10 Claims, 3 Drawing Sheets

METHOD FOR MAKING FLAKES OF RE-FE-B TYPE MAGNETICALLY ALIGNED MATERIAL

This invention relates to methods and apparatus for forming anisotropic permanently magnetic material from particles of magnetically isotropic preforms of finely crystalline alloys containing one or more light rare earth (RE) elements, one or more transition metals (TM) and boron with a Nd—Fe—B type intermetallic phase and more particularly to methods and apparatus for hot working such isotropic particles so as to magnetically align most of the grains or crystallites therein.

BACKGROUND OF THE INVENTION

Permanent magnet compositions based on the rare earth (RE) elements neodymium or praseodymium or both, the transition metal iron or mixtures of iron and cobalt, and boron are known. Preferred compositions contain a large proportion of a $RE_2TM_{14}B$ phase where TM is one or more transition metal elements including iron. A preferred method of processing such alloys involves rapidly solidifyng molten alloy to achieve a substantially amorphous to very finely crystalline microstructure that has isotropic, permanently magnetic properties. In another preferred method, overquenched alloys without appreciable coercivity can be annealed at suitable temperatures to cause grain growth and thereby induce magnetic coercivity in a material having isotropic permanently magnetic properties.

It is also known that particles of rapidly solidified RE—Fe—B based isotropic alloys can be hot pressed into a substantially fully densified body and that such body can be further hot worked and plastically deformed to make an excellent anisotropic permanent magnet. Thus, alloys with overquenched, substantially amorphous microstructures are worked and plastically deformed at elevated temperatures to cause grain growth and crystallite orientation which result in substantially higher energy products than in the best as-rapidly-solidified alloys. The maximum energy product to date for hot worked, melt-spun Nd—Fe—B magnet bodies is up to about 50 MGOe, although energy products as high as 64 M GOe are theoretically possible.

As stated above, the preferred rare earth (RE)-transition metal (TM)-boron (B) permanent magnet composition consists predominantly of $RE_2TM_{14}B$ grains with a RE-containing minor phase(s) present as a layer at the grain boundaries. It is particularly preferred that on the average the $RE_2TM_{14}B$ grains be no greater than about 500 nm in greatest dimension in the permanent magnet product.

While such hot die upsetting is suitable for its intended purpose, in certain manufacturing processes it would be desirable to directly convert the isotropic particles to anisotropic permanently magnetic particles. Such anisotropic particles can then be mixed with a suitable matrix material and shaped to form a bonded permanent magnet having magnetically anisotropic properties.

STATEMENT OF THE INVENTION AND ADVANTAGES

The present invention contemplates a method and apparatus for making flakes of permanent magnetically anisotropic material from, e.g., melt spun ribbon particles of amorphous or finely crystalline material having grains of $RE_2TM_{14}B$ where RE is one or more rare earth elements at least sixty percent of which is rare earth material such as neodymium and/or praseodymium, TM is iron or iron-cobalt combinations and B is the element boron. The ribbon is fragmented, if necessary, into individual particles of such isotropic material. The individual particles are then heated to a plastic state and individually worked to deform each particle to align crystallites or grains therein along a magnetically preferred axis and to form flakes of material which are not fused. The flakes with such aligned crystallites are then individually cooled and collected for use in the manufacture of permanent magnets having magnetically anisotropic properties.

A feature of the present invention is to provide a method wherein the individual particles of magnetically isotropic material are passed through a heat source to heat the individual particles to a plastic state; and thereafter the particles are impelled while in their plastic state against spaced surfaces of a hot working device; thereafter the individual particles are shaped into individual flakes by deforming the particles between the spaced surfaces while in their plastic state. The method contemplates maintaining a controlled separation of the individual particles during such shaping to prevent fusion of the resultant individual flakes while producing a crystallite grain structure therein aligned along a crystallographically preferred magnetic axis.

A further feature of the method of the present invention is to provide a method of the type set forth in the preceding objects and features wherein the isotropic particles are heated to a plastic state by heating them by directing them with respect to a plasma torch and impelling such particles against the shaping die surfaces by plasma spraying.

Yet another feature of the present invention is that the isotropic particles be processed while in their plastic state by a continuous process including shaping the plastic particles by directing them through a gap between hot working rolls.

Still another feature of the present invention is to provide methods of the type set-forth above including sizing the individual particles in the range of from 1 to 350 $\mu$m to form a resultant anisotropic flake material suitable for mixing with matrix material from which different shaped anisotropic permanent magnets can be subsequently processed.

Yet another object is to provide apparatus to practice the aforesaid methods wherein the apparatus includes a plasma spray system and a pair of counter-rotating rollers to shape particles sprayed from a plasma spray system as individual flakes of magnetically anisotropic material.

BRIEF SUMMARY OF THE PREFERRED EMBODIMENT

My method is applicable to compositions comprising a suitable transition metal component, a suitable rare earth component, and boron.

The transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component—largely iron.

The composition also comprises from about 10 atomic percent to about 50 atomic percent rare earth component. Neodymium and/or praseodymium are the essential rare earth constituents. As indicated, they may be used interchangeably. Relatively small amounts of other rare earth elements, such as samarium, lanthanum, cerium, terbium and dysprosium, may be mixed with neodymium and praseodymium without substantial loss of the desirable magnetic properties. Preferably, they make up no more than about 40 atomic percent of the rare earth component. It is expected that there will be small amounts of impurity elements with the rare earth component.

The composition contains at least 1 atomic percent boron and preferably about 1 to 10 atomic percent boron.

The overall composition may also be expressed in the general formula $Re_{1-x}(TM_{1-y}B_y)_x$. The rare earth (RE) component makes up 10 to 50 atomic percent of the composition (x=0.5 to 0.9), with at least 60 atomic percent of the rare earth component being neodymium and/or praseodymium. The transition metal (TM) as used herein makes up about 50 to 90 atomic percent of the overall composition, with iron representing at least about 60 to 80 atomic percent of the transition metal content. The other constituents, such as cobalt, nickel, chromium or manganese, are called "transition metals" insofar as the above empirical formula is concerned.

Boron is present in an amount of about 1 to 10 atomic percent (y=0.01 to 0.11) of the total composition.

The practice of my invention is applicable to a family of iron-neodymium and/or praseodymium-boron containing compositions which are further characterized by the presence or formation of the tetragonal crystal phase specified above, illustrated by the atomic formula $RE_2TM_{14}B$, as the predominant constituent of the material. In other words, the hot worked permanent magnet product contains at least fifty percent by weight of this tetragonal phase. Here RE means principally Nd or Pr and the easy magnetic direction is parallel to the "c" axis of the tetragonal crystal. The suitable composition also contains at least one additional phase, typically a minor phase at the grain boundaries of the $R_2TM_{14}B$ phase. The minor phase contains the rare earth constituent and is richer in content of such constituent than the major phase.

For convenience, the compositions have been expressed in terms of atomic proportions. Obviously these specifications can be readily converted to weight proportions for preparing the composition mixtures.

For purposes of illustration, my invention will be described using compositions of approximately the following proportions:

$$Nd_{0.13}(Fe_{0.95}B_{0.05})_{0.87}$$

However, it is to be understood that our method is applicable to a family of compositions as described above.

Such compositions are arc melted to form alloy ingots. The ingots are remelted and rapidly solidified, e.g., melt spun, i.e., discharged, through a nozzle having a small diameter outlet onto a rotating chill surface. The molten metal alloy is thus solidified almost instantaneously and comes off the rotating surface in the form of small ribbon like particles.

The resultant product may be amorphous or it may be a very finely crystalline material. If the material is crystalline, it contains the $Nd_2Fe_{14}B$ type intermetallic phase which has high magnetic symmetry. The quenched material is magnetically isotropic as formed.

Depending on the rate of cooling, molten transition metal-rare earth-boron compositions can be solidified to have a wide range of microstructures. Thus far, however, melt-spun materials with grain sizes greater than several microns do not yield preferred permanent magnet properties. Fine grain microstructures, where the grains have a maximum dimension of about 20 to 500 nanometers, have coercivity and other useful permanent magnet properties. Amorphous materials do not. However, some of the glassy microstructure materials can be annealed to convert them to fine grain permanent magnets having isotropic magnetic properties. My invention is applicable to such overquenched, glassy materials. It is also applicable to "as-quenched" high coercivity, fine grain materials. Care must be taken to avoid excessive time at high temperature to avoid coercivity loss through excessive grain growth.

In accordance with the present invention such ribbon formed alloy is broken into coarse powder particles.

Individual particles of such rapidly solidified material are then heated and directed onto a hot working surface of a suitable deforming apparatus. The individual particles are deformed by the apparatus while in a plastic state (approx. 750° C.). Each Nd—Fe—B particle is plastically deformed to cause generally spherically configured grains in the individual particles to be flattened so as to cause the grains or crystallites to be oriented along a crystallographically preferred magnetic axis and thereby produce magnetically anisotropic material.

In a preferred embodiment of the invention apparatus is provided to feed the magnetically isotropic particles from a feed hopper by means of a carrier gas. The particles are heated by a plasma arc and are discharged from a plasma spray gun against two counter-rotating rollers spaced to form a deforming gap therebetween. The gap is sized to be about half the size of the minor dimension of the ribbon particles so as to provide the required amount of deformation. The particles are discharged from the plasma spray gun against the roller surfaces upstream of the gap.

The process of shaping the particles takes place while the particles are in a plastic state (approximately 750° C.). In apparatus for practice of the invention, the plastic particles are splattered across the rollers upstream of the gap such that a substantial percentage of the particles are separately deformed in the roller gap without being fused into larger particles The dimension of the gap can be vaned to control the amount of deformation.

The resultant deformed particles are flattened from a spheroidal shape to a flake form. The flakes are cooled and ejected from the downstream end of the gap as individual flakes.

During such deformation, the individual isotropic grains in the plastic spheroid are rotated such that their "c" axis of the $(Nd,Pr)_2TM_{14}B$ phase becomes normal to the direction of the plastic flow imparted by the rotating rollers. Such orientation along a crystallographically preferred magnetic axis produces magnetically anisotropic material in the resultant individual flakes.

The aforesaid objects and advantages of my invention will be better understood from the succeeding detailed description of the invention and the accompanying drawings thereof.

DETAILED DESCRIPTION OF THE DRAWINGS

DETAILED DESCRIPTION OF THE INVENTION

Figure 1:
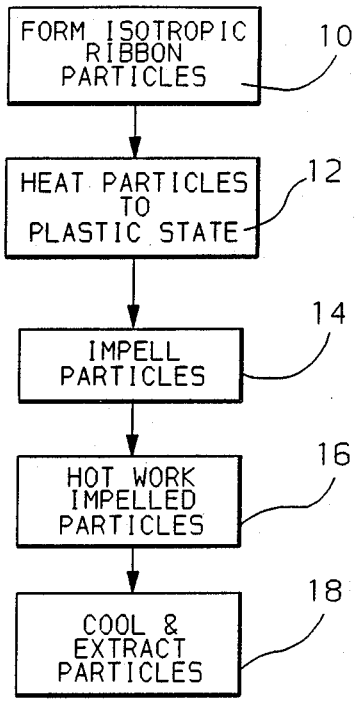
FIG. 1 is a chart showing a preferred practice of the present invention.

Referring now to FIG. 1, the inventive method of the present invention includes the following generalized steps:

1. Forming 10 ribbon particles of magnetically isotropic material.
2. Heating 12 each of the individual particles to a temperature at which the particles are in a plastic state.
3. Impelling 14 of the plastic particles onto the surfaces of a hot working apparatus;
4. Shaping 16 each of the particles to form a resultant flake of magnetically anisotropic material.
5. Cooling and extracting 18 the particles in flake form from the hot working apparatus without fusing the individual flakes.

The forming step 10 of my invention is applicable to magnetically isotropic, amorphous or fine grain materials that are comprised of basically spherically shaped, randomly oriented $Nd_2$—$FE_{14}$—B grains with rare earth rich grain boundaries.

Figure 2:
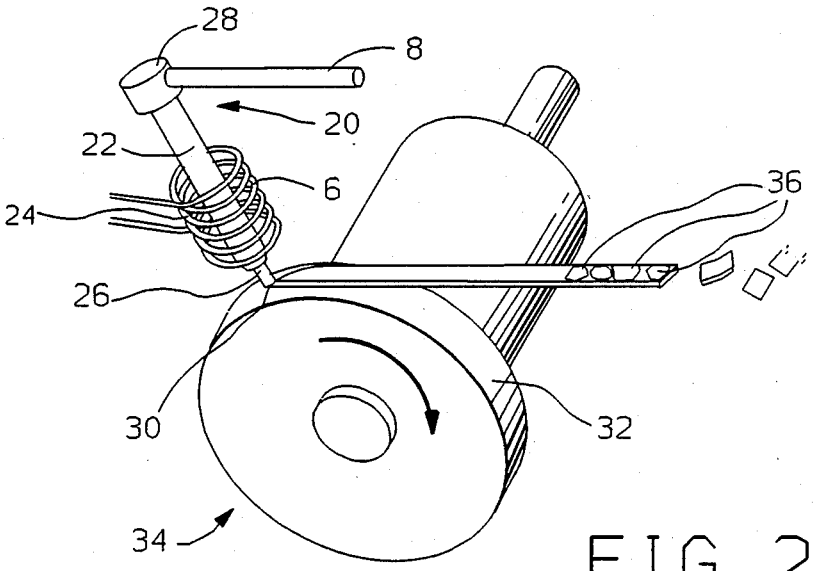
FIG. 2 is a diagrammatic view of apparatus for making magnetically isotropic ribbon particles.

Suitable compositions can be made by melt spinning apparatus 20 as shown in FIG. 2. The Nd—Fe—B starting material is contained in a suitable vessel, such as a quartz crucible 22 The composition is melted by an induction or resistance heater 24. The melt is pressurized by a source 8 of inert gas, such as argon. A small, circular ejection orifice 26, e.g., about 500 microns in diameter, is provided at the bottom of the crucible 22. A closure 28 is provided at the top of the crucible so that the argon can be pressurized to eject the melt from the vessel in a very fine stream 30.

The molten stream 30 is directed onto a moving chill surface 32 located about one-quarter inch below the ejection orifice. In examples described herein, the chill surface is a 25 cm diameter, 1.3 cm thick copper wheel 34. The circumferential surface is chrome plated. The wheel does not need to be cooled in small runs since its mass is so much greater than the amount of melt impinging on it in any run that its temperature does not appreciably change. Alternatively, a water cooled wheel can be used. When the melt hits the turning wheel, it flattens, almost instantaneously solidifies and is thrown off as a ribbon or ribbon particles 36. The thickness of the ribbon particles 36 and the rate of cooling are largely determined by the circumferential speed of the wheel. In this work, the speed can be varied to produce a desired fine grained ribbon for practicing the present invention.

The cooling rate or speed of the chill wheel preferably is such that a fine crystal structure is produced which, on the average, has $Re_2TM_{14}B$ grains no greater than about 500 nm in greatest dimension and preferably less than 200 nm in greatest dimension.

The ribbon alloy is broken or pulverized into coarse size powder particles 38, on the order of an average size of 150 um at the greatest dimension.

The starting material size can be selected from a range of from one to 350 um particles from the broken or fragmented ribbon 36.

Figure 3:
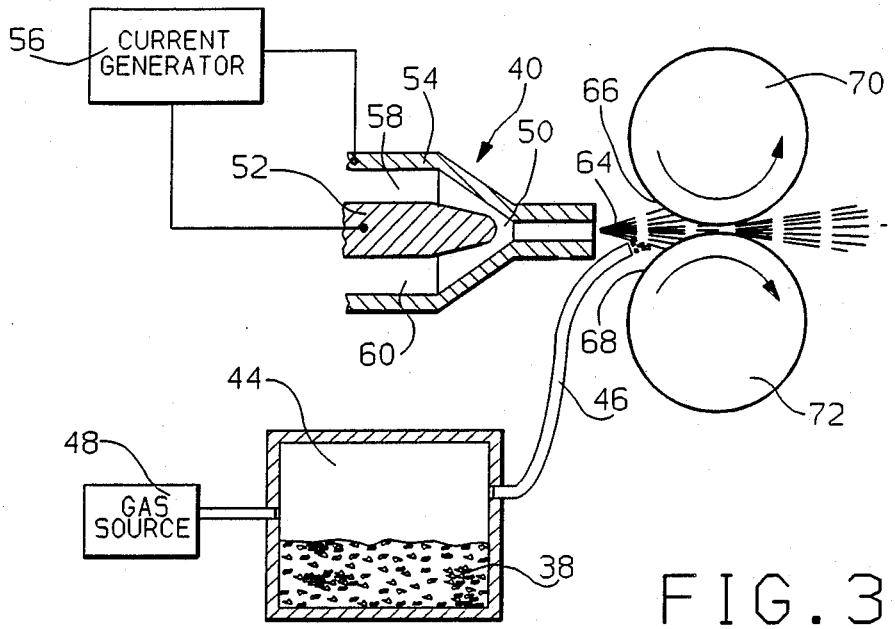
FIG. 3 is a diagrammatic view of apparatus for plasma spraying and hot working the ribbon particles of FIG. 2.

FIG. 3 shows plasma spray apparatus 40 and rolls 70, 72 for carrying out the aforesaid steps of heating 12; impelling 14; shaping 16 and cooling and extracting 18. Specifically the apparatus includes a plasma spray gun 40 which is connected to a feed hopper 44 by a carrier tube 46. The feed hopper 44 has particles of the magnetically isotropic ribbon therein. The feed hopper is pressurized by a suitable inert carrier gas from a source 48. The carrier gas directs the particles 38 into the plasma spray pattern 64 at a point downstream of the plasma torch 40. The plasma is formed between the electrode 52 and a conductive housing segment 54. The electrode 52 and the housing segment 54 are connected across a suitable arc current generator 56. Arc gas is directed through passages 58, 60 to produce a plasma spray 64 into which the particles are injected by the carrier gas. The temperature of the spray 64 at the particle entry point must be such as to heat the particles to the plastic state (approximately 750° C.) without melting.

The spray pattern 64 is impelled against the surfaces 66, 68 of a pair of counter-rotating rollers 70, 72 arranged and operative to hot work each of the individual particles.

Figure 4:
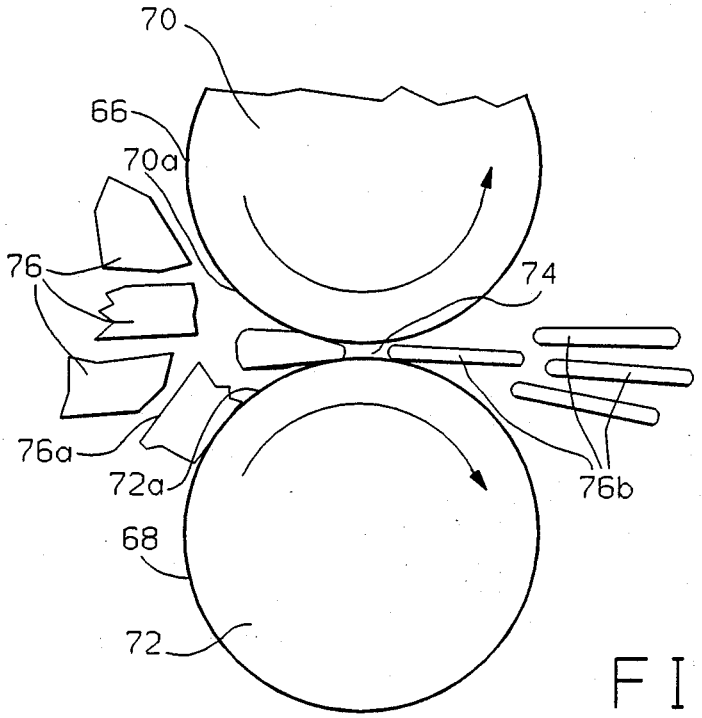
FIG. 4 is an enlarged region of the view of FIG. 3 showing the upstream end of a deforming gap in the apparatus of FIG. 2.

As best shown in FIG. 4 the rollers 70, 72 are supported on drive axes which define a gap 74 therebetween. The gap 74 has a dimension less than the size of the individual particles 76 impelled against the rollers 70, 72. The impelled particles 76 are generally platelet shaped and will deform to slightly globular form as they impact on the roller segments **70*a*, 72*a* upstream of the gap 74**.

The impacted globules **76*a* are drawn by rotation of the rollers 70, 72 into the gap 74 which is sized to reduce the shape of the platelet 76*a* to a very shallow profile platelet 76*b*. The platelet shaped particles 76*a*, 76*b* remain in a plastic state during such deformation and the splatter pattern of the particles against the roller segments 70*a*, 72*a* is selected so that the greatest number of the impacted particles remain separated without fusion therebetween. Consequently, the majority of the platelets 76*b*** are not fused.

The platelets **76*b* are cooled as they pass from the outlet or downstream end of the gap 74**. The resultant product is a number of individual platelets of material which have been deformed.

Figure 5:
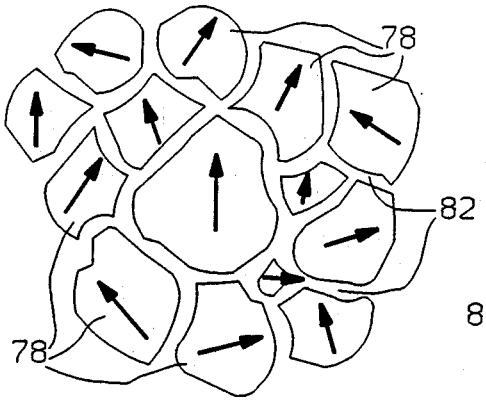
FIG. 5 is a diagrammatic representation of spherically configured isotropic grains.

As shown in FIG. 5, before the particles 76 are deformed they have spherical grains or crystallites 78 therein of magnetically isotropic material. As illustrated the "c" axis of the $RE_2TM_{14}B$ grains are arranged in random direction to cause such isotropic properties. viously, the grains are illustrated at a very large magnification and the thickness of the intergranular phase 82 is exaggerated.

Figure 6:
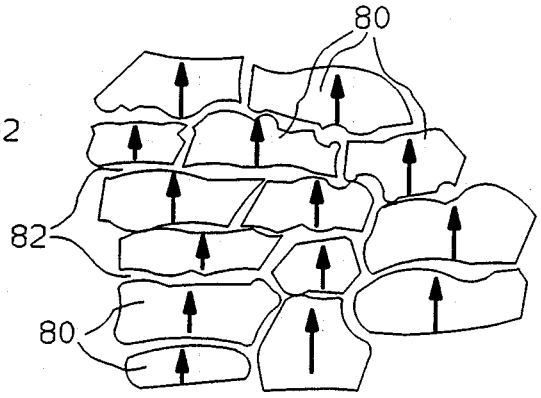
FIG. 6 is a diagrammatic representation of such grains deformed to produce anisotropic grains.

As the particles 76 are reshaped by hot working from the spherical shape 76 to the flake shape **76*b*, the grains 78 are formed as platelets 80 (see FIG. 6) having their "c" axes rotated into a direction which is normal to the hot deforming or flattening action described above. Such alignment of the grains along crystallographically preferred magnetic axis results in the formation of flakes 76*b*** with good permanent magnetically anisotropic characteristics.

The rollers 70, 72 can have coolant directed therethrough to regulate the rate at which the flakes **76*b* are cooled within gap 74**. For the process to work, the plasma sprayed particles must pass between the rollers while above their plastic state. Any cooling of the particles below their plastic state can result in crushing of the particles which will prevent hot working crystallographic orientation.

Figure 7:
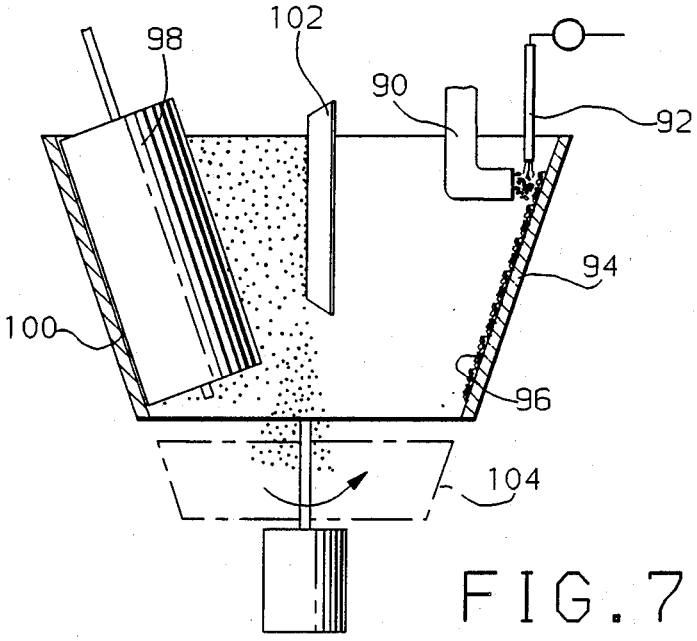
FIG. 7 is a diagrammatic view of another process for deforming such isotropic grains.

While calendering type rollers are shown in the apparatus of FIG. 3, it should be understood that other roll forming apparatus is equally suited for use in practicing the invention. Likewise other heat sources and impelling system can be used to direct the isotropic starting material into a deformation gap. For example, as shown in FIG. 7 the particles can be directed from a spray nozzle 90 through an arc formed between a heating electrode 92 and centrifuge bowl 94. The bowl 94 has an inner surface 96 which receives the impelled heated particles in a plastic state and to which the particles adhere. The bowl is rotated with respect to a roller 98 which forms a gap 100 with the inner surface 96 dimensioned to flatten platelets of isotropic material to a flake form of anisotropic material. A scrapper 102 is provided to remove the flakes from the inner surface 96 for collection in a hopper 104. The deformation of the particles produces the same desired crystallographic orientation of the magnetic axes of grains in each of the individual particles. The particles are separated by the splatter pattern against the inner surface 96 to prevent fusion of the individual particles during the deformation at gap 100 and subsequent extraction from the apparatus.

Obviously, other embodiments of the practice of my invention could be adapted. For example, particles of magnetically isotropic material could be suitably heated as they are dropped down a vertically disposed tube onto the gap between a pair of horizontally disposed working rolls.

While representative embodiments of apparatus and processes of the present invention have been shown and discussed, those skilled in the art will recognize that various changes and modifications may be made within the scope and equivalency range of the present invention.

What is claimed is:

1. A method of making magnetically anisotropic flakes of a composition comprising iron, neodymium and/or praseodymium and boron, said flakes either having appreciable coercivity as processed or being heat treatable to acquire such coercivity, said method comprising:

preparing a molten mixture comprising a transition metal (TM) taken from the group consisting of iron and mixtures of iron and cobalt, one or more rare earth metals (RE) including neodymium and praseodymium, and boron, the proportions of such constituents being sufficient to form a product that consists essentially of the tetragonal crystalline compound having the empirical formula $Re_2TM_{14}B$, rapidly solidifying such mixture to form a magnetically isotropic amorphous material or a very finely crystalline material containing said compound and having small, generally spherical grains of an average size no greater than about 200 nm, sizing said material as discrete particles having a nominal dimensions of from about 2 um to about 350 um, heating the particles to a hot working temperature, impelling the heated particles individually against a moving working surface of a hot working device in such a controlled and restrained fashion that the heated particles contact the hot working device significantly separated, one from the others, carrying said particles in a direction away from incoming hot isotropic particles by the movement of said moving working surface, pressing the impelled, significantly separated individual particles between the moving working surface and a cooperating surface to produce plastic flow in the particles, thereby flattening the grains and making magnetically anisotropic flakes, without fusing together significant numbers of the flakes, and removing and cooling the flakes, the flakes containing said crystalline compound, and still having an average grain size no greater than about 500 nm.

2. In the method of claim 1, heating the particles of isotropic material by directing them with respect to a plasma torch and impelling such particles against the cooperating working surfaces of the hot working device by plasma spraying.

3. In the method of claim 1, pressing the plastic particles in a gap formed between counter-rotating rolls.

4. A method for processing permanent magnetic isotropic alloy material based on rare earth elements, iron and boron to make permanently magnetically anisotropic material and wherein the magnetically isotropic alloy material has generally spherically shaped grains of $RE_2TM_{14}B$ wherein RE is one or more rare earth elements at least sixty percent of which is neodymium and/or praseodymium, TM is iron or iron-cobalt combinations and B is the element boron, comprising:

forming the isotropic material as individual particles;

heating the individual particles by plasma spraying them against a pressure shaping tool;

pressure shaping the individual particles while in a plastic state into individual flakes without fusing significant numbers of the individual flakes one to the other;

and during such pressure shaping hot plastically deforming grains in the particles from a spherical shape to a brick-like shape which on the average are not greater than about 500 nm in greatest dimension for aligning the $RE_2TM_{14}B$ grain structure along a crystallographically preferred magnetic axis; and removing the individual flakes from the pressure-shaping tool and cooling them.

5. In the method of claim 4, providing a pressure shaping tool having a gap formed therein of a dimension less than the minimum dimension of the heated particles and pressure shaping the heated particles by directing them through the gap individually and without substantial fusion therebetween.

6. In the method of claim 5, sizing the individual particles of starting material in the range of from one to 350 um.

7. In the method of claim 5, sizing the individual particles of starting material to have a nominal average size of 150 um.

8. In the method of claim 4, pressure shaping the individual particles, while in a plastic state into individual flakes by impelling said particles through a gap between a pair of counter-rotating rollers.

9. In the method of claim 8, sizing the individual particles of starting material in the range of from one to 350 um.

10. In the method of claim 8, sizing the individual particles of starting material to have a nominal average size of 150 um.

* * * * *